US005241344A

United States Patent [19]

Takano

[11] Patent Number: 5,241,344

[45] Date of Patent: Aug. 31, 1993

[54] STRUCTURE FOR MOUNTING SCREEN GRID OF CORONA CHARGER IN IMAGING DEVICE

[75] Inventor: Masatoshi Takano, Tokyo, Japan

[73] Assignee: Asahi Kogaku Kogyo Kabushiki Kaisha, Tokyo, Japan

[21] Appl. No.: 917,996

[22] Filed: Jul. 24, 1992

[30] Foreign Application Priority Data

Jul. 25, 1991 [JP] Japan ..... 3-86155

[51] Int. Cl.[5] ..... G03G 15/02; G03G 21/00

[52] U.S. Cl. ..... 355/225; 250/324; 355/221

[58] Field of Search ..... 250/324, 325, 326; 355/219, 221, 225

[56] References Cited

U.S. PATENT DOCUMENTS

| | | | |
|---|---|---|---|
| 4,420,248 | 12/1983 | Ogawa et al. | 355/57 |
| 4,469,428 | 9/1984 | Yoshioka et al. | 250/325 X R |
| 4,603,964 | 8/1986 | Swistak | 355/225 |
| 4,725,732 | 2/1988 | Lang et al. | 250/326 |
| 4,764,675 | 8/1988 | Levy et al. | 250/324 |
| 5,001,733 | 3/1991 | Negoro et al. | 377/88 |
| 5,008,538 | 4/1991 | DeCecca et al. | 250/324 |
| 5,055,878 | 10/1991 | Okamoto et al. | 355/219 |
| 5,101,239 | 3/1992 | Nishikawa et al. | 355/274 |

FOREIGN PATENT DOCUMENTS

| | | | |
|---|---|---|---|
| 62-269176 | 11/1987 | Japan | 355/225 |
| 2-160263 | 6/1990 | Japan | 355/221 |

*Primary Examiner*—Fred L. Braun

*Attorney, Agent, or Firm*—Sandler, Greenblum & Bernstein

[57] ABSTRACT

A structure for mounting a screen grid member of a corona charger in an imaging device with a predetermined positional relation to the surface of a photoconductive member. The corona charger and the photoconductive member are mounted on a support base member. The support base member is provided with a mount opening where a substantially inverted U-shaped screen grid member carrying the screen grid is inserted. First locking lugs project from the inner wall surfaces of the mount opening, each of the first locking lugs having a surface opposite to a surface facing toward the photoconductive member formed as a locking surface substantially normal to the inner wall surface. Second locking lugs project from the inner wall surfaces of the mount opening, each of the second locking lugs having a surface facing the photoconductive member, formed as a locking surface substantially normal to the inner wall surface. Locking holes are defined on the screen grid member at the positions corresponding to the first locking lugs and the second locking lugs, respectively. The screen grid member is inserted into the mount opening and fixed thereto through engagements of the locking holes with the locking lugs.

11 Claims, 4 Drawing Sheets

STRUCTURE FOR MOUNTING SCREEN GRID OF CORONA CHARGER IN IMAGING DEVICE

BACKGROUND OF THE INVENTION

The present invention relates to a structure for mounting a screen grid of a corona charger which is used to charge the surface of a photoconductive member in an electrophotographic process.

Imaging devices (so-called printers) for providing a hard copy by printing or drawing output data from a computer, word processor, facsimile and the like on a recording paper by employing a so-called electrophotographic process. In the electrophotographic process, a photoconductive material on the surface of a photoconductive member is uniformly charged, a latent image is formed onto a portion of the photoconductive member by photoconductive material from which electric charges are removed by exposure, this latent image is developed by depositing toner thereon (made to a toner image), then the toner image is transferred to a recording paper and further fixed thereto by a fixing unit.

Such imaging device usually charges the photoconductive material on the surface of the photoconductive member by a corona charger provided in close proximity to the photoconductive member.

The corona charger includes charge wires and a shield plate surrounding the charge wires and opened toward the photoconductive member side. When a high voltage is imposed on the charge wires, corona discharge is directed toward the photoconductive member and ambient air which is ionized by the corona discharge is moved against the photoconductive material, thereby charging it.

To create a good image, a constant electric potential must be charged on the surface of the photoconductive member. For this purpose, conventionally, a screen electrode plate formed to a grid shape or the like (i.e., a so-called screen grid) is provided to the opening of the shield plate of the corona charger confronting the photoconductive member, and a current flowing to the photoconductive material is controlled by a voltage imposed on the screen grid to thereby stabilize the electric potential on the surface of the photoconductive material.

The screen grid is grounded through a Zener diode or varister so that a constant voltage is imposed on the screen grid.

In the above arrangement, since the screen grid must have pinpoint positional accuracy with respect to the photoconductive member to charge a constant electric potential on the surface of the photoconductive member with a high accuracy, the positioning and mounting of the screen grid is very tedious and time-consuming.

SUMMARY OF THE INVENTION

It is therefore an object of the present invention to provide an improved structure capable of easily mounting a screen grid of a corona charger in an imaging device with pinpoint accuracy.

For the above purpose, according to the present invention, there is provided a structure for mounting a screen grid of a corona charger in an imaging device with a predetermined positional relation to the surface of a photoconductive member, wherein said corona charger and said photoconductive member are mounted on a support base member, said support base member being provided with a mount opening where said corona charger is to be arranged, and wherein said screen grid is formed on a screen grid member having a substantially inverted-U shaped sectional configuration to be received in the mount opening.

The structure includes approaching direction locking lugs projecting from the inner wall surfaces of the mount opening, each of which has a surface, opposite to a surface facing the photoconductive member, and formed as a locking surface substantially normal to the inner wall surface;

retracting direction locking lugs projecting from the inner wall surfaces of the mount opening, each of which has a surface facing the photoconductive member formed as a locking surface substantially normal to the inner wall surface; and locking holes defined in the screen grid member at the positions corresponding to the approaching direction locking lugs and retracting direction locking lugs, respectively. The screen grid member is inserted into the mount opening and positioned and fixed thereto through the locking holes thereof engaged with the approaching direction locking lugs and the retracting direction locking lugs, respectively.

According to this arrangement, the screen grid carried by the screen grid member is positioned and fixed through the locking holes thereof engaged with the first locking lugs and second locking lugs only by inserting the screen grid member into the mount opening of the support base member.

DESCRIPTION OF THE ACCOMPANYING DRAWINGS

DESCRIPTION OF THE EMBODIMENTS

An embodiment of the present invention will be described below with reference to the accompanying drawings.

Figure 1:
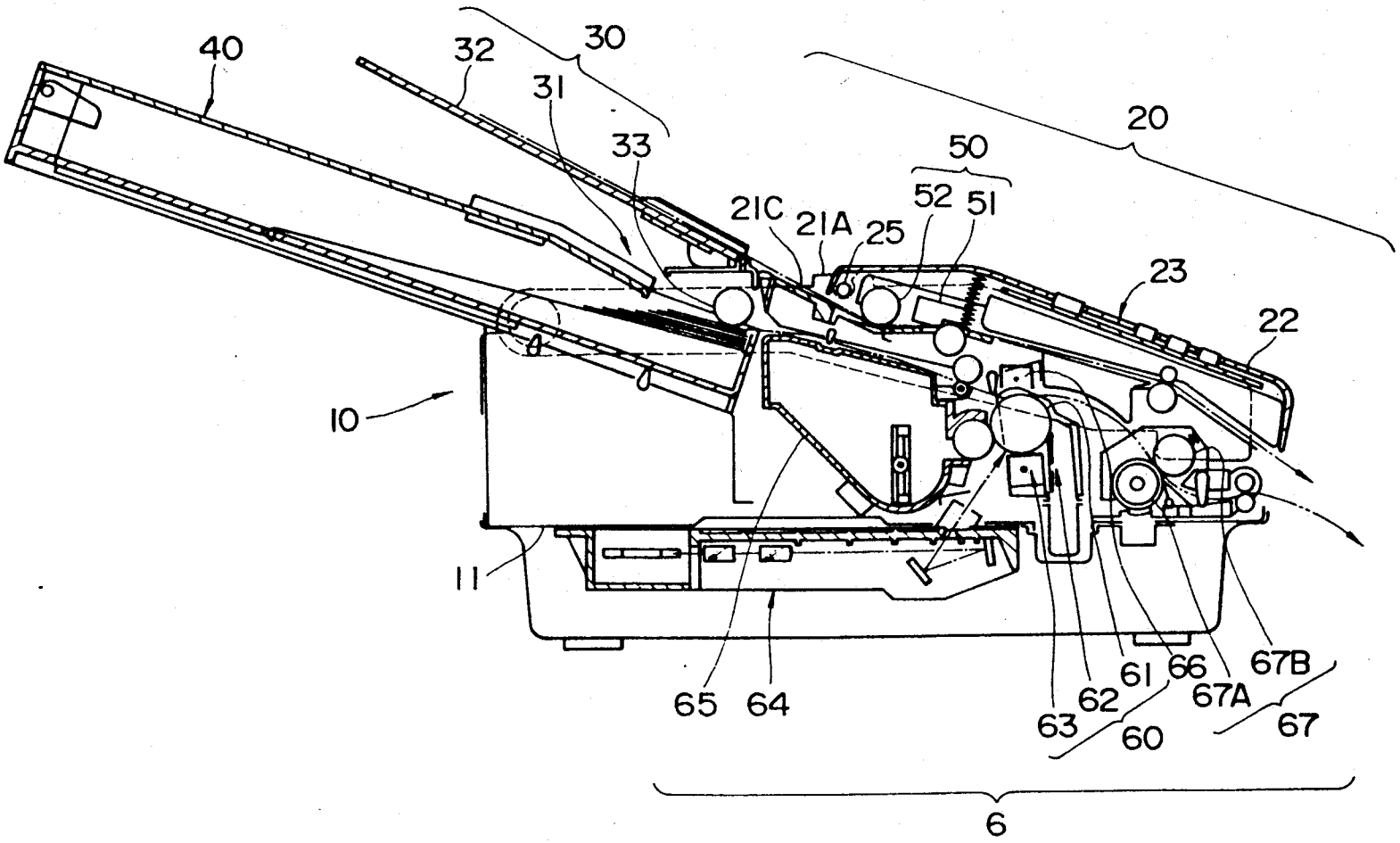
FIG. 1 is a side view showing the schematic arrangement of an electrophotographic facsimile device to which an embodiment of a structure for mounting a screen grid according to the present invention is applied.

FIG. 1 is a side view showing the schematic arrangement of an electrophotographic facsimile device, wherein the right side corresponds to the front surface of the device.

The illustrated facsimile device includes a paper supply unit 30 at the upper rear end of a main body 10 for supplying recording paper into the device for receiving information, or for supplying a document for transmitting information. The upper front portion of the device contiguous to the paper supply unit 30 is composed of an upper arrangement member 20 supported by an arm 21A at the end on the paper supply unit 30 side (rear side) of the main body 10.

The paper supply unit 30 includes a cassette mounting portion 31 detachably mounted to a recording paper cassette 40, which accommodates information receiving recording papers as cut sheet papers, and a document holder 32 for an information transmitting document mounted in front of the cassette mounting portion 31 (right side in FIG. 1). A recording paper introduction roller 33 is disposed at the position corresponding to the upper front end of the recording papers accommodated in the recording paper cassette 40 mounted to the cassette mounting portion 31.

The upper arrangement member 20 has an upper surface formed as an inclined surface gradually declining toward the front end of the device and a portion of the declined surface is arranged as an operation unit 23 including a display panel, operation buttons and the like, disposed thereon.

A document reading mechanism is disposed in the upper arrangement member 20, and composed of a reading head 50 including a reading sensor 51 and a document introduction roller 52 disposed on the document holder 32 side in the vicinity of the reading sensor 51, and a document feed path formed in confrontation with the reading head 50. A document placed on the document holder 32 of the paper supply unit 30 is introduced into the upper arrangement member 20 by the document introduction roller 52 and fed along the path shown by the dot-dash-line in FIG. 1. Information written on the document is read by the reading sensor 51, and then the document is discharged through a document discharge port defined to the front surface of the front end of the main body 10.

A recording unit 6 having an imaging unit including various operation mechanisms for an electrophotographic process is provided with the main body 10.

The recording unit 6 includes a cleaning mechanism 62 for cleaning toner remaining on the surface of a photoconductive drum 61 by abutting a blade formed of an elastic member against the surface thereof, a corona charger 63 for uniformly charging the photoconductive material on the surface of the photoconductive drum 61, a scanning optical system unit 64 for exposing and scanning the surface of the photoconductive drum 61 with a laser beam turned ON and OFF in response to image data, a development unit 65 for depositing toner to a portion of the photoconductive material from which electric charges are removed by exposure and made into a latent image and on which the latent image is made into a toner image, and a transfer charger 66 for charging a recording paper and transferring the toner image thereon. Each unit is disposed about the photoconductive drum 61 and driven in rotation at a predetermined circumferential speed by a drive motor (not shown). Further, a fixing unit 67 is disposed at a location to which the recording paper transferred with the toner image is fed. Fixing unit 67 includes a heat roller 67A which is heated to a predetermined temperature, and a press roller 67B disposed obliquely upwardly of the heat roller 67A on the front end side of the facsimile device, and pressed against the heat roller 67A.

The recording papers accommodated in the recording paper cassette 40 are sequentially introduced into a recording paper path from the uppermost one thereof by the rotation of the recording paper introduction roller 33, while the surface of the photoconductive drum 61 is main-scanned (exposed) by a laser beam supplied from the scanning optical system unit 64 and modulated in response to received print or image data. The photoconductive drum 61 is rotated as well (sub-scanned), so that an electrostatic latent image is formed on the surface of the photoconductive drum 61. This latent image is developed into a toner image by the development unit 65, the toner image is transferred to a recording paper, fed along a path shown in FIG. 1 by the two-dot-and-dash line and charged by the transfer charger 66. Further, the toner image is fixed to the recording paper by the fixing unit 67, and then the recording paper is discharged through the front end of the facsimile device.

Figure 2:
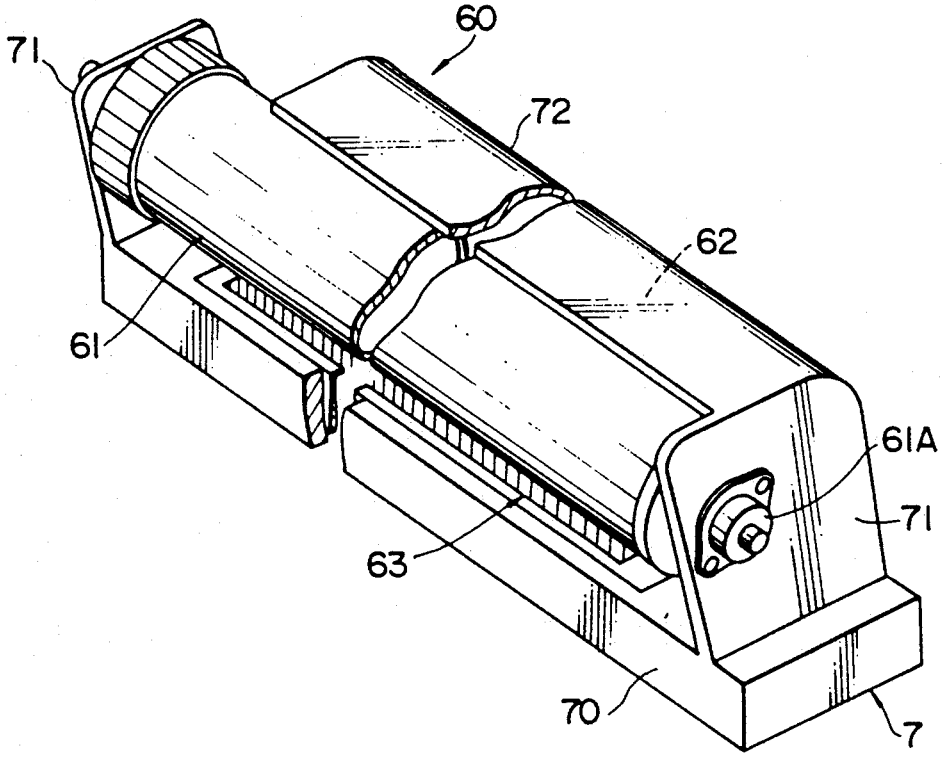
FIG. 2 is a perspective view of a drum unit.

The photoconductive drum 61, cleaning mechanism 62 and corona charger 63 of the above recording unit 6 are integrally mounted to a single unit frame 7 and arranged as a drum unit 60, as shown in the perspective view of it in FIG. 2. When the photoconductive drum 61 is to be replaced because the photoconductive material on the photoconductive drum 61 is worn or the electrostatic characteristics of the photoconductive drum 61 are degraded, this drum unit 60 is replaced as a whole.

Figure 3:
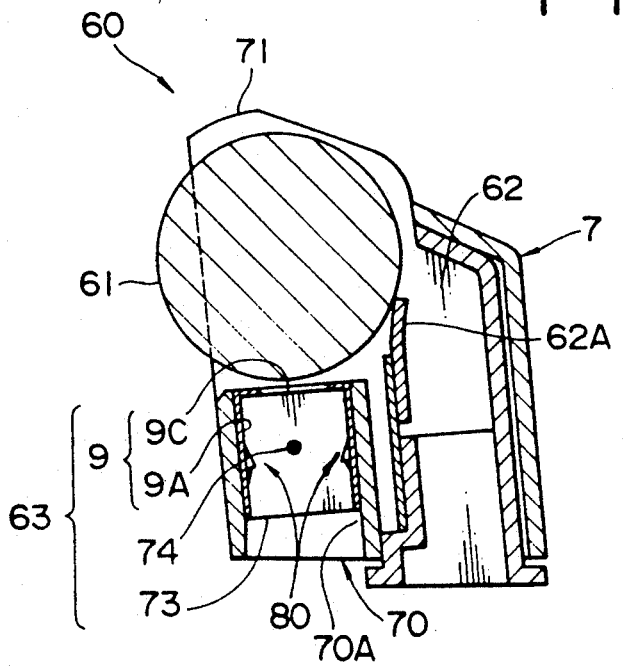
FIG. 3 is a vertical sectional view of the drum unit shown FIG. 2.

As shown in the exploded perspective view of FIG. 3, the unit frame 7 includes base 70, side plates 71, 71 vertically disposed on the right and left sides of the base 70, and cleaning mechanism case 72 coupled with the side plates 71, 71.

The photoconductive drum 61 is rotatably supported by the side plates 71, 71 through bearings 61A, 61A mounted to the opposite ends thereof.

A charger mount opening 70A is defined vertically (in the thickness direction) through the base 70 along the lengthwise direction thereof (in parallel with the photoconductive drum 61 supported by the side plates 71, 71) and the corona charger 63 is disposed in the opening 70A.

The charger mount opening 70A has a width and length enabling a screen grid member 9 to be described later to be inserted thereinto and the length is substantially as long as the photoconductive drum 61. Locking portions 80 are formed on the inner wall surfaces on the opposite sides in the lengthwise direction of the charger mount opening 70A and located at the front and rear ends of the wall surfaces.

Figure 4:
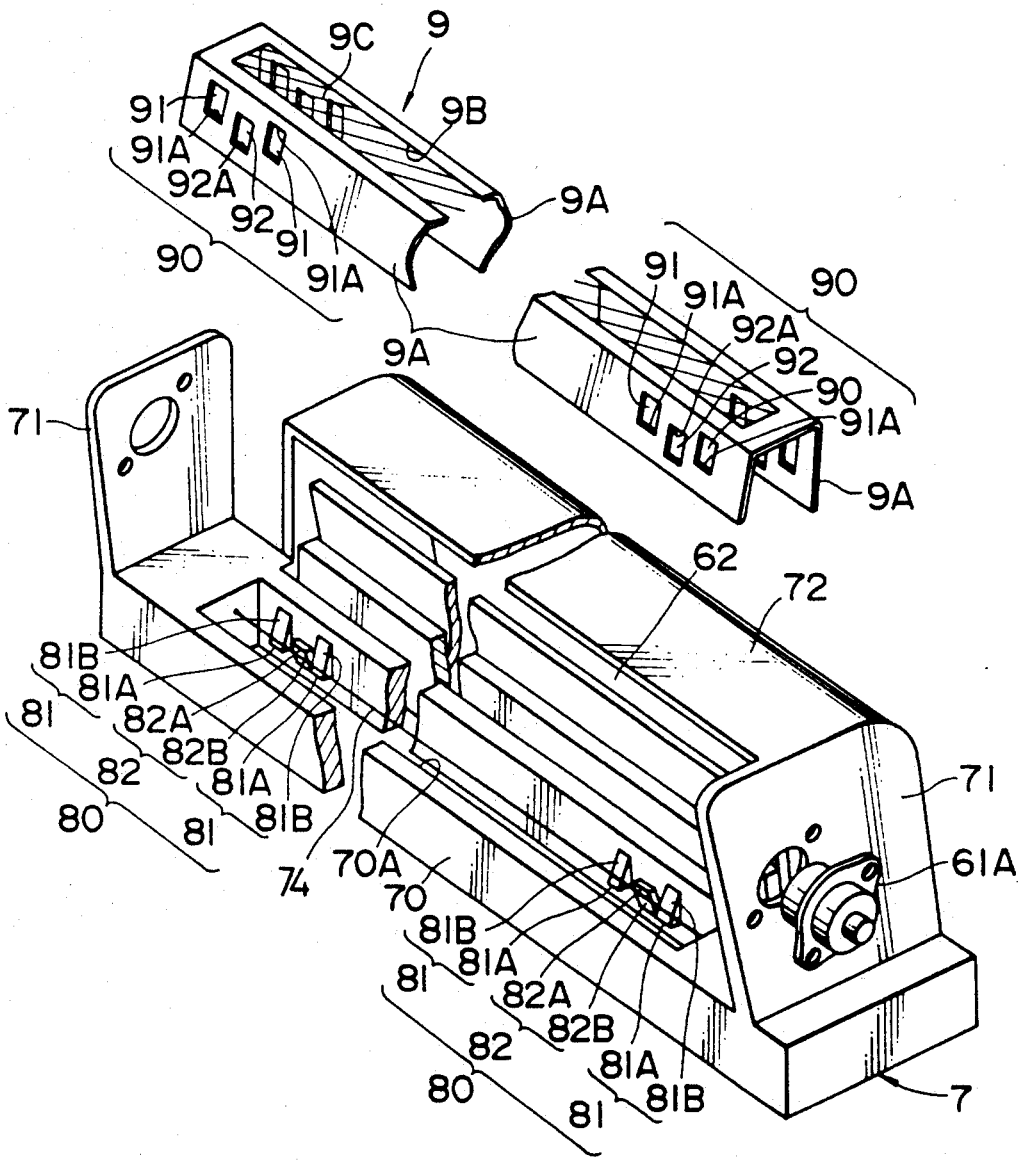
FIG. 4 is a exploded perspective view of the drum unit.

As shown in FIG. 4, each of the locking portions 80 includes right and left approaching direction locking lugs 81, 81 and a retracting direction locking lug 82 is disposed therebetween.

The approaching direction locking lug 81 has locking surface 81A substantially normal to the inner wall surface of the charger mount opening 70A and inclined guide surface 81B gradually descending at a predetermined angle to the inner wall surface as it approaches to the photoconductive drum 61 from the extreme end of the locking surface 81A and formed to a right-angled triangular pyramid with the substantially horizontal bottom surface (locking surface 81A) thereof.

Figure 5:
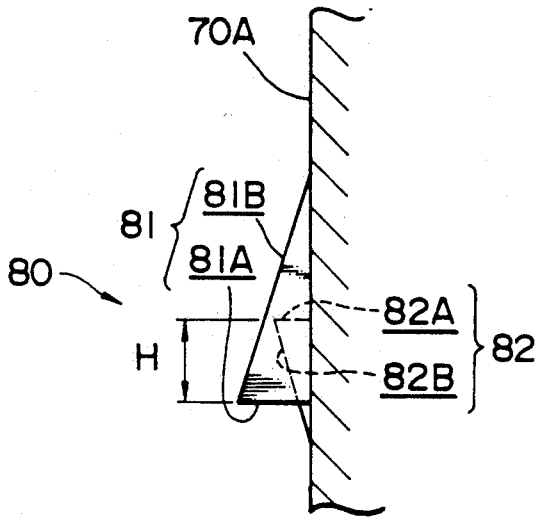
FIG. 5 is an enlarged side view of an engagement portion.

The retracting direction locking lug 82 is formed as a right-angled triangular pyramid obtained by vertically upsetting the approaching direction locking lug 81. The retracting direction locking lug 82 has an inclined surface 82B formed such that it gradually descends at a predetermined angle to the inner wall surface as the lower side thereof (the side opposite to the photoconductive drum 61) is apart from the photoconductive drum 61. As shown in the partially enlarged side view of the locking portion 80 in FIG. 5, the approaching direction locking lug 81 is positioned in a vertical direction such that a distance H is provided between the locking surface 82A of the retracting direction locking lug 82 and the locking surface 81A of the approaching direction locking lug 81. Further, as shown also in FIG.

5, the height of the locking surface 82A from the inner wall surface of the charger mount opening 70A is set lower than the height of the inclined guide surface 81B of the approaching direction locking lug 81, at the position thereof corresponding to the locking surface 82A from the above inner wall surface, by a predetermined amount. More specifically, when viewed from a horizontal direction as in FIG. 5, the vertex of the retracting direction locking lug 82 cannot be seen because it is behind the approaching direction locking lug 81.

The screen grid member 9 is engaged with the locking portions 80 and disposed in the charger mount opening 70A arranged as described above. Charge wires 74, illustrated only in FIG. 3, are stretched at the center of the charger mount opening 70A along the lengthwise direction thereof. The corona charger 63 comprises the charge wires 74 and the screen grid member 9. This screen grid member 9 functions as a shield plate member.

The screen grid member 9 is formed to a substantially inverted U-shaped cross section with side plates 9A, 9A vertically disposed in the longitudinal direction on the opposite sides thereof. The upper surface (the bottom surface of the U-shape) of the screen grid member 9 has a flat shape and substantially the entire area of the upper surface is arranged as an opening 9B.

A plurality of conductive metal wires 9A forming a screen grid are stretched at predetermined intervals in the opening 9B between the front and rear edges in the lengthwise direction thereof at a predetermined angle with respect to the lengthwise direction.

Engagement hole portions 90 are defined in each of the side plates 9A, 9A, and when the screen grid member 9 is correctly mounted to the charger mount opening 70A of the base 70 of the unit frame 7 (i.e., when the screen grid member 9 is located to have a predetermined positional relationship with respect to the photoconductive drum 61), the positions of the engagement hole portions 90 correspond to the positions of the locking portions 80.

Figure 6:
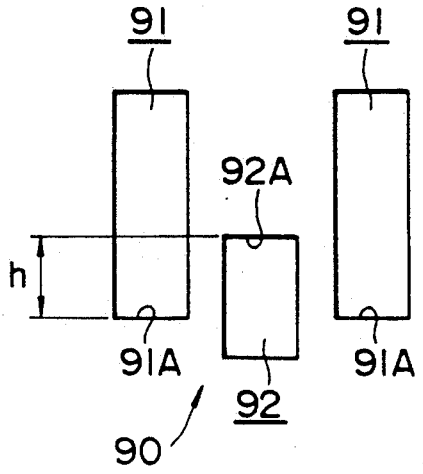
FIG. 6 is a partially enlarged view of an engagement hole portion.

As shown in the partially enlarged plan view of FIG. 6, each of the engagement hole portions 90 includes approaching direction locking holes 91 defined at the positions corresponding to the approaching direction locking lugs 81 of the locking portion 80, and a retracting direction locking hole 92 defined at the position corresponding to the retracting direction locking lug 82. In this state, the approaching direction locking lugs 81 can be inserted into the approaching direction locking holes 91 and the retracting direction locking lugs 82 can be inserted into the retracting direction locking hole 92.

A tolerance of a predetermined amount is set between the vertical distance h from the edge 91A of the approaching direction locking hole 91, confronting the locking surface 81A of the approaching direction locking lug 81 shown in FIG. 6, and the aforesaid distance H so that the distance H can be contained within the distance h without causing backlash.

With the above arrangement, when the screen grid member 9 is inserted into the charger mount opening 70A of the unit frame 7 from the upper side thereof (from the photoconductive drum 61 side), the lower ends of the side plates 9A, 9A are abutted against the inclined guide surfaces 81A of the approaching direction locking lugs 81 and elastically deformed inwardly thereof, and when the side plates 9A, 9A are inserted to a predetermined position, the locking hole portions 80 are undetachably engaged with the locking portions 80 by the elastic return force of the side plates 9A, 9A. More specifically, the approaching direction locking lugs 81 are inserted into the approaching direction locking holes 91 and the retracting direction locking lugs 82 are inserted into the retracting direction locking holes 92. With this arrangement, the movement of the screen grid member 9 in the upward direction (the movement to approach the photoconductive drum 61) is regulated by the approaching direction locking lugs 81 and the movement thereof in the downward direction (movement for retracting from the photoconductive drum 61) is regulated by the retracting direction locking lugs 82. Note, as described above, since the height of the retracting direction locking lug 82 is lower than the height of the corresponding portion of the inclined guide surface 81B of the approaching direction locking lug 81, when the screen grid member 9 is inserted, the movement and deformation of the side plates 9A, 9A are not prevented by the retracting direction locking lugs 82.

As described above, since the tolerance between the vertical distance h and the distance H is set so that the distance H can be contained within the distance h without causing backlash, the screen grid member 9 is mounted to the charger mount opening 70A (i.e., to the unit frame 7) at a preset position in a vertical direction. More specifically, when the approaching direction locking lugs 81 and retracting direction locking lugs 82 are formed to the unit frame 7 with a predetermined accuracy with respect to the position where the photoconductive drum 61 is mounted, the screen grid member 9 can be positioned apart from the photoconductive drum 61 by a predetermined distance with a predetermined accuracy and mounted to the charger mount opening 70A in such a manner that the locking hole portions 90 are engaged with the locking portions 80, only by inserting the screen grid member 9 into the charger mount opening 70A.

Note that the number and the location of the approaching direction locking lugs 81 and retracting direction locking lugs 82 are not limited to those employed by the above embodiment and can be suitably changed.

Further, although the height of the retracting direction locking lug 82 is set lower than the height of the corresponding portion of the inclined guide surface 81B of the approaching direction locking lug 81 to insert the screen grid member 9 into the charger mount opening 70A from the photoconductive drum 61 side, the height of the approaching direction locking lug 81 may be set lower than the height of the corresponding portion of the inclined guide surface 82B of the retracting direction locking lug 82 to enable the screen grid member 9 to be inserted into the charger mount opening 70A from the side opposite to the photoconductive drum 61 side.

The present disclosure relates to subject matter contained in Japanese Utility Model Application No. HEI 3-86155 filed on Jul. 25, 1991, which is expressly incorporated herein by reference in its entirety.

What is claimed is:

1. A structure for mounting a screen grid of a corona charger in an imaging device with a predetermined positional relation to the surface of a photoconductive member, wherein said corona charger and said photoconductive member are mounted on a support base member, said support base member being provided with a mount opening which is longitudinally bordered by inner wall surfaces, and defines where said corona charger is to be arranged, and wherein said screen grid is formed on a screen grid member having a substantially inverted-U shaped sectional configuration to be received in said mount opening, said structure comprises:

approaching direction locking lugs projecting from the inner wall surfaces of said mount opening, each of said approaching direction locking lugs having a surface opposite to a surface facing toward said photoconductive member formed as a locking surface substantially normal to said inner wall surface;

retracting direction locking lugs projecting from the inner wall surfaces of said mount opening, each of said retracting direction locking lugs having a surface facing towards said photoconductive member, formed as a locking surface substantially normal to said inner wall surface; and locking holes defined in said screen grid member at positions corresponding to said approaching direction locking lugs and said retracting direction locking lugs, respectively, wherein said screen grid member is inserted into said mount opening and positioned and fixed thereto through the locking holes thereof engaged with said approaching direction locking lugs and said retracting direction locking lugs, respectively.

2. The structure according to claim 1, wherein the surface of said approaching direction locking lug or said retracting direction locking lug on the side thereof where said screen grid member is inserted into said mount opening is formed as an inclined guide surface inclining toward the inner wall surface of said mount opening.

3. The structure according to claim 2, wherein the surface of said approaching direction locking lug on said photoconductor member side is formed as said inclined guide surface and said screen grid member is mounted to said support base member from said photoconductive member side.

4. The structure according to claim 3, wherein the height of the locking surface of said retracting direction locking lug is lower than the height of the corresponding portion of the inclined guide surface of said approaching direction locking lug.

5. The structure according to claim 4, wherein the locking surfaces of said approaching direction locking lugs are formed on the opposite side of said approaching direction locking lugs, as compared with the locking surfaces of said retracting direction locking lugs formed on said retracting direction locking lugs.

6. The structure according to claim 5, wherein a combination of said approaching direction locking lugs and said retracting direction locking lug is formed in each of four corners of the inner wall surfaces of said mount opening confronting the opposite sides in the lengthwise direction of said screen grid member.

7. A structure for positioning and mounting a mounting member to a support frame member, comprising:

a mount opening formed in said support frame member into which said mounting member can be inserted;

first locking lugs projecting from the inner wall surfaces of said mount opening, each of said first locking lugs having a first locking surface substantially normal to said inner wall surface for regulating a position in a direction substantially orthogonal to said first locking surface;

second locking lugs projecting from the inner wall surfaces of said mount opening, each of said second locking lugs having a second locking surface confronting the first locking surface of said first locking lug for regulating a position in a direction substantially orthogonal to said second locking surface; and locking holes defined to said mounting member at the positions corresponding to said first locking lugs and said second locking lugs, respectively, wherein said mounting member is inserted into said mount opening and fixed thereto through the locking holes thereof engaged with said first locking lugs and said second locking lugs, respectively.

8. The structure according to claim 7, wherein the surface of one of said first and second locking lugs on the side thereof where said mounting member is inserted into said mount opening is formed as an inclined guide surface inclining toward the inner wall surface of said mount opening.

9. The structure according to claim 8, wherein the height of the locking surface of the other of said first and second locking lugs is lower than the height of the corresponding portion of the inclined guide surface of said one of the first and second locking lugs.

10. The structure according to claim 9, wherein said first locking lugs are formed on the opposite sides of said second locking lugs.

11. The structure according to claim 10, wherein a combination of said first and second locking lugs is formed in each of four corners of the inner wall surfaces of said mount opening.

* * * * *